US005996876A

United States Patent [19]

Dickhoff et al.

[11] Patent Number: 5,996,876

[45] Date of Patent: Dec. 7, 1999

[54] STAPLING DEVICE

[75] Inventors: Andreas Dickhoff, Rochester, N.Y.; Helmut Domes, Stuttgart; Reinhard Weltz, Leonberg, both of Germany

[73] Assignee: Eastman Kodak Company, Rochester, N.Y.

[21] Appl. No.: 09/195,907

[22] Filed: Nov. 19, 1998

[30] Foreign Application Priority Data

Nov. 26, 1997 [DE] Germany ..... 197 52 286

[51] Int. Cl.[6] ..... B27F 7/21; B25C 5/08

[52] U.S. Cl. ..... 227/85; 227/88; 227/132; 227/152; 227/153

[58] Field of Search ..... 227/85, 88, 87, 227/131, 132, 152, 153, 82, 89

[56] References Cited

U.S. PATENT DOCUMENTS

| | | | |
|---|---|---|---|
| 1,705,819 | 3/1929 | Kruse . | |
| 3,231,168 | 1/1966 | Ward | 227/88 |
| 4,203,446 | 5/1980 | Hofert et al. | 227/132 |
| 4,318,555 | 3/1982 | Adamski et al. | 227/88 |
| 4,356,947 | 11/1982 | Marshall et al. | 227/152 |
| 4,557,410 | 12/1985 | Holden et al. . | |
| 4,770,334 | 9/1988 | Hoshi et al. | 227/85 |
| 5,098,002 | 3/1992 | Hansch et al. | 227/88 |

FOREIGN PATENT DOCUMENTS

| | | |
|---|---|---|
| 379 457 | 7/1990 | European Pat. Off. . |
| 779 198 | 3/1935 | France . |
| 73 24 364 | 2/1981 | Germany . |
| 40 20 355 C2 | 2/1996 | Germany . |
| 678 154 | 2/1948 | United Kingdom . |

*Primary Examiner*—Scott A. Smith
*Attorney, Agent, or Firm*—Clyde E. Bailey, Sr.

[57] ABSTRACT

A stapling device has a holddown element, a staple forming member, and a staple driving means, which are guided linearly and are movable perpendicular to the upper side of a sheet stack to be stapled.

A first pressure spring with a lower spring force is associated with the holddown element. A second pressure spring whose spring force is greater than that of the first pressure spring, is associated with the staple forming member. A third pressure spring is associated with the staple driving means, its spring force being greater than that of the second pressure spring. The pressure springs are arranged with identical working directions perpendicular to the upper side of the sheet stack.

The first pressure spring is arranged in preloaded fashion between the holddown element and the staple forming member. The second pressure spring is arranged in preloaded fashion between the staple forming member and the staple driving means. The third pressure spring is arranged in preloaded fashion between the staple driving means and a drive head on which engages an eccentric drive which moves the stapling device in the direction of the arrow onto sheet stack, and thereby controls a force-controlled drive mechanism of the stapling device in an operationally correct sequence.

2 Claims, 3 Drawing Sheets

STAPLING DEVICE

FIELD OF THE INVENTION

The invention relates to a stapling device for stapling a stack of sheets by means of staples, in which the staples are formed from wire in the stapling device and are subsequently driven into the sheet stack.

BACKGROUND OF THE INVENTION

Stapling devices are known (see U.S. Pat. No. 4,557,410, titled "Stapler Mechanism Powering Means," issued Dec. 10, 1985, by Holden, et al., and DE 40 20 355 C2, incorporated by reference herein) in which the individual functions required for stapling are controlled by means of a cam control system and associated levers as transfer elements. In these known stapling devices, individual functions for stapling are activated, upon rotation of a drive plate through an angular range, by means of the shape of the cam plate and the transfer elements engaging thereon.

DE 73 24 364 U1 (incorporated by reference herein) discloses a stapling device of the generic type with which a wire segment is cut off from a staple wire supply and formed into a staple. A bender forming the staple has a counterbearing for a pressure spring which is arranged in a displaceable driver. When the bender is driven, the movement of the driver is inhibited until the bending operation for producing the staple is complete. At the same time, the pressure spring is preloaded. After completion of the bending operation, the driver is enabled so that, under the influence of the preloaded pressure spring, it can drive the finished staple into the sheet stack.

The known stapling devices are susceptible to wear and malfunction because of their complex construction, and moreover require a comparatively large installation space.

SUMMARY OF THE INVENTION

It is the object of the invention to configure a stapling device of the generic type in such a way as to guarantee not only simple construction but also operationally correct and reliable function.

According to one aspect of the present invention, this object is achieved in that:

- the stapling device has a holddown element, a staple forming member, and a staple driving means, which are guided linearly and are movable perpendicular to the upper side of the stack;
- a first, a second, and a third pressure spring, with identical working directions but with different spring forces in each case, are arranged perpendicular to the upper side of the stack;
- the first pressure spring engages on the holddown element associated with the upper side of the stack and has a low spring force;
- the second pressure spring is associated with the staple forming member and has a spring force which is greater than that of the first pressure spring;
- the third pressure spring is associated with the staple driving means and has a spring force which is greater than that of the second pressure spring;
- the pressure springs can be acted upon by a common drive mechanism of the stapling device which is movable in the working direction of the pressure springs;
- the drive mechanism is associated with the one end of the pressure spring arrangement; and
- the other end of the pressure spring arrangement faces toward the sheet stack to be stapled.

The present invention is directed to overcoming one or more of the problems set forth above.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

The arrangement, configuration, and manner of operation of the pressure springs according to the invention result, advantageously, in a force-controlled operating sequence for the stapling device such that when the stapling device is actuated, first of all the first pressure spring with the lowest spring force is compressed, and then the second pressure spring with the higher spring force, and lastly the third pressure spring with the highest spring force, so that the temporal sequence of the stapling operation is controlled in operationally correct fashion in a simple manner with little wear.

Advantageously, the pressure springs are each arranged, in accordance with their spring force, in preloaded fashion between those associated subassemblies which are actuated successively in temporal sequence. Advantageously, the adjacent subassemblies have projections against which the ends of the particular associated pressure springs can brace.

The subassemblies of the stapling device are, advantageously, guided in linearly displaceable fashion, thus making possible components of simple configuration which can move reliably and with little wear. Actuation of the device can moreover be accomplished by means of a simply constructed drive, so that the entire stapling device can be produced economically and can be configured in space-saving fashion.

Because simple pressure springs are used, the spring force-controlled functional sequence of the stapling device according to the invention is particularly robust and reliable.

Further features and advantages are evident from the description of an embodiment of the invention depicted in the drawings, and from the claims.

Figure 1:
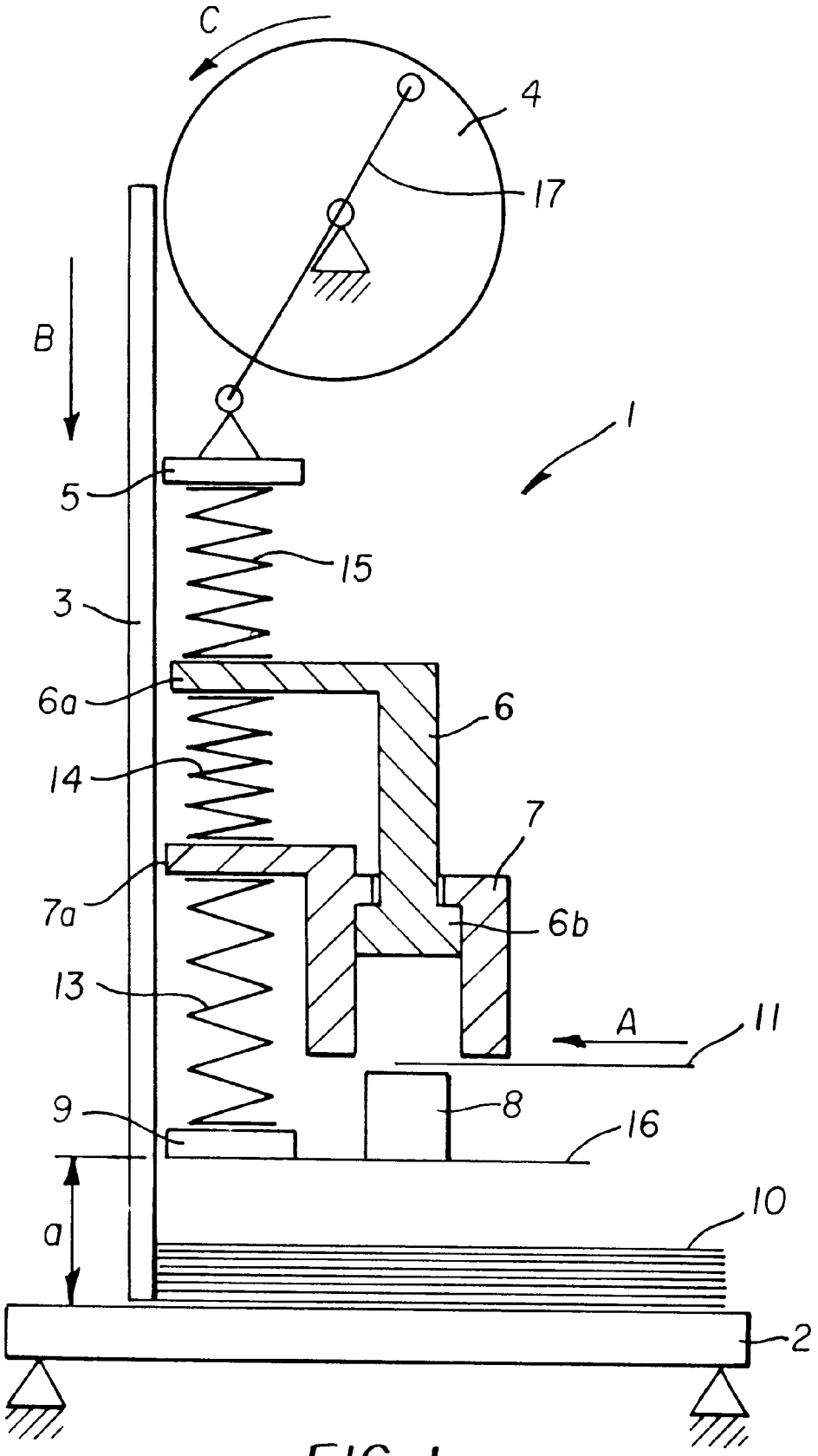
FIG. 1 is the device in its initial position.

To simplify the drawing, only the components of a stapling device which are essential to the invention are illustrated in their schematic configuration. To facilitate understanding, identical reference numerals have been used, where possible, to designate identical elements that are common to the figures.

DETAILED DESCRIPTION OF THE INVENTION

Referring to FIG. 1, stapling device 1 substantially comprises a holddown element 9 with an associated first pressure spring 13 having a low spring force C1, a staple forming member 7 with an associated second pressure spring 14 having a spring force C2 which is greater than that of first pressure spring 13, a staple driving means 6 with an associated third pressure spring 15 having a spring force C3 which is greater than that of second pressure spring 14, a bending block 8 associated with staple forming member 7, an eccentric drive 4, 17 mounted in stationary fashion, and a drive head 5 associated with the latter and with third pressure spring 15.

Holddown element 9, staple forming member 7, staple driving means 6, and drive head 5 are guided in linearly displaceable fashion on a support 3 of stapling device 1 in a known manner (not depicted).

Staple driving means 6 on which staple forming member 7 is displaceably guided has in the guidance region a T-shaped extension 6*b*. Said extension 6*b* delimits the maximum distance between a projection 6*a* of staple driving means 6 and a projection 7*a* of staple forming member 7, with second pressure spring 14 being arranged in preloaded fashion between said two projections 6*a* and 7*a*.

Similar connections, not depicted in order to simplify the drawing, also exist between drive head 5 and projection 6*a* of staple driving means 6, between which third pressure spring 15 is arranged in preloaded fashion, and between projection 6*a* of staple forming member 7 and holddown element 9, between which first pressure spring 13 is arranged in preloaded fashion.

The dimensions of pressure springs 13, 14, and 15 are defined as a function of the thickness of sheet stack 10 to be stapled and of the nature of the sheet and/or film material to be stapled, in such a way that, for example, third pressure spring 15 has a preload force of 250 to 300 N, second pressure spring 14 a preload force of 80 N, and first pressure spring 13 a preload force of 20 N. If only thinner sheet stacks are to be stapled, a preload force of 100 N may then be sufficient for third pressure spring 15.

Staple wire 11 for the forming of staples 12 is delivered to stapling device 1 in the direction of the arrow "A" and is stored in known fashion (not depicted) on a wire spool. After delivery to stapling device 1, staple wire 11 is cut off, also in a known fashion (not depicted), to a length necessary for the staple size, the length of the cut-off wire segment being adaptable in known fashion to the sheet stack thickness to be stapled.

The mode of operation of the device is as follows:

The initial position of stapling device 1 depicted in FIG. 1 is determined by the inactive position of eccentric drive 4, 17 and the preloads of pressure springs 13, 14, and 15 acting on the individual components 5, 6, and 7, respectively, in which, as shown in FIG. 1, a lower limiting means 16 of stapling device 1 assumes a defined distance "a" from collecting station 2.

Once the sheets to be stapled have been collected in collecting station 2 into a sheet stack 10 and have been accurately aligned by known means (not depicted), eccentric drive 4 is set in rotary motion in the direction of the arrow "C." A crank rod articulated on eccentric drive 4 eccentrically with respect to the rotation axis thereof is joined at its other end to drive head 5, and moves the latter in the direction of the arrow "B."

Figure 2:
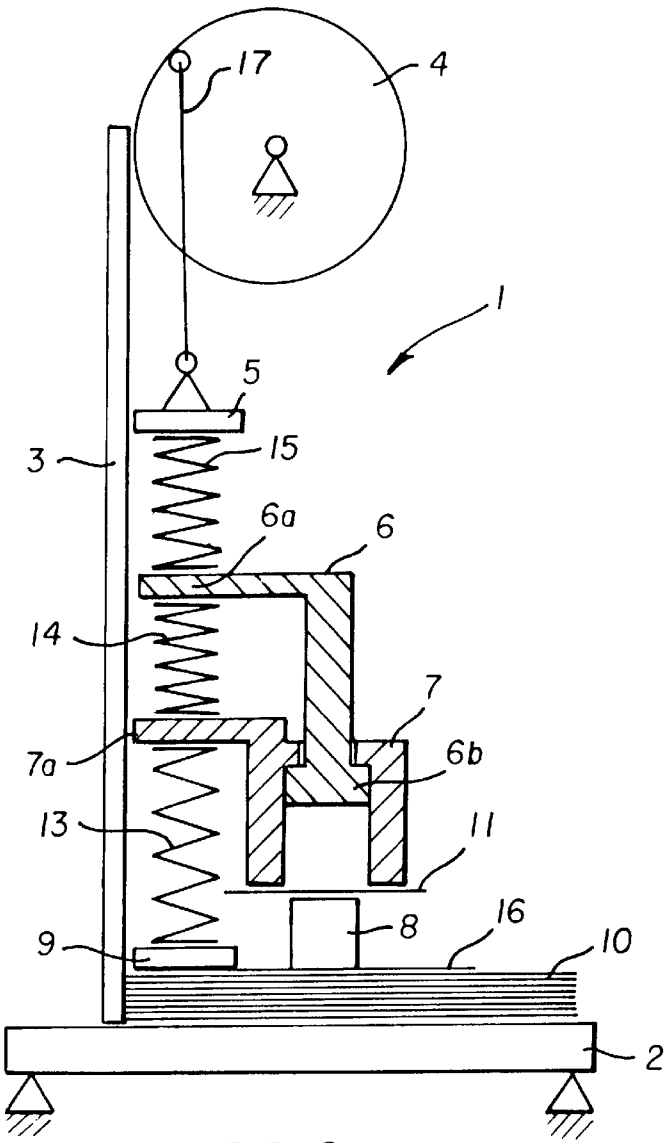
FIG. 2 is the device according to FIG. 1, during application onto the sheet stack.

The entire stapling device 1 is thereby moved, by means of the strongest third pressure spring 15, downward in the direction of the arrow "B" until holddown element 9 shown in FIG. 2 rests on sheet stack 10 and compresses it.

Figure 3:
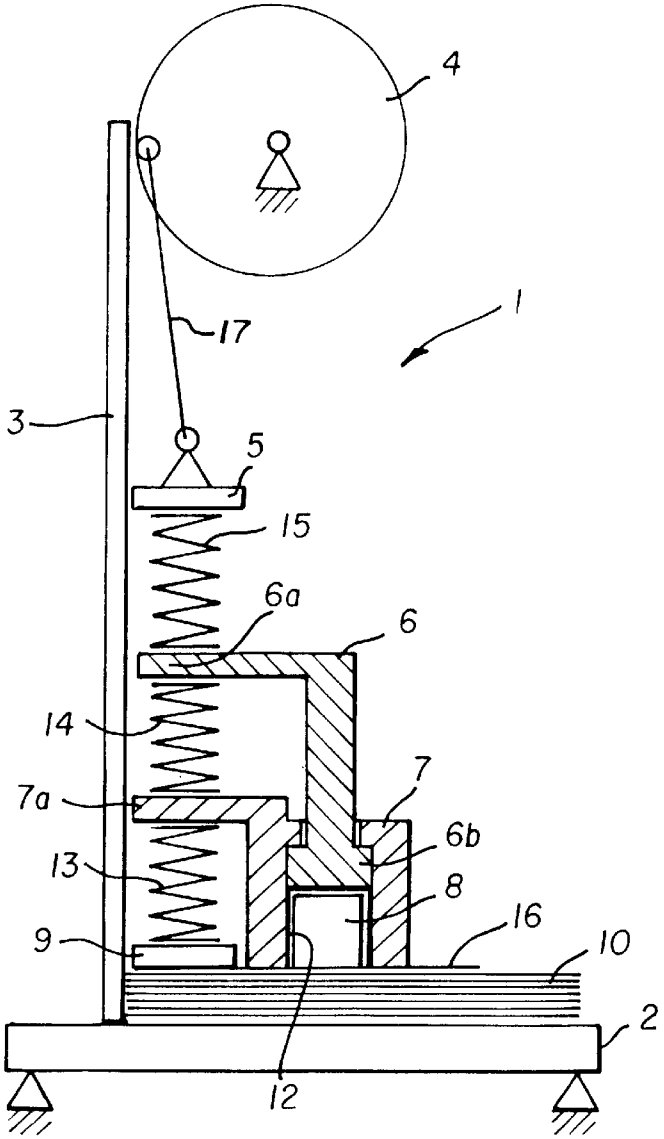
FIG. 3 is the device according to FIG. 1, as the staple is being formed.

Upon further movement in the direction of the arrow "B", the ends of the wire segment, as visible in FIG. 3, are bent downward around bending block 8 by staple forming member 7, thereby forming staple 12. This bending operation takes place under the influence of the second, stronger pressure spring 14, which overcomes the strength of the first, weaker pressure spring 13 and compresses the latter.

Once staple 12 has been formed, further movement of the stapling device in the direction of the arrow "B" first moves bending block 8 in a manner not depicted to the side away from staple 12, so that it lies outside the further movement path of staple driving means 6.

Figure 5:
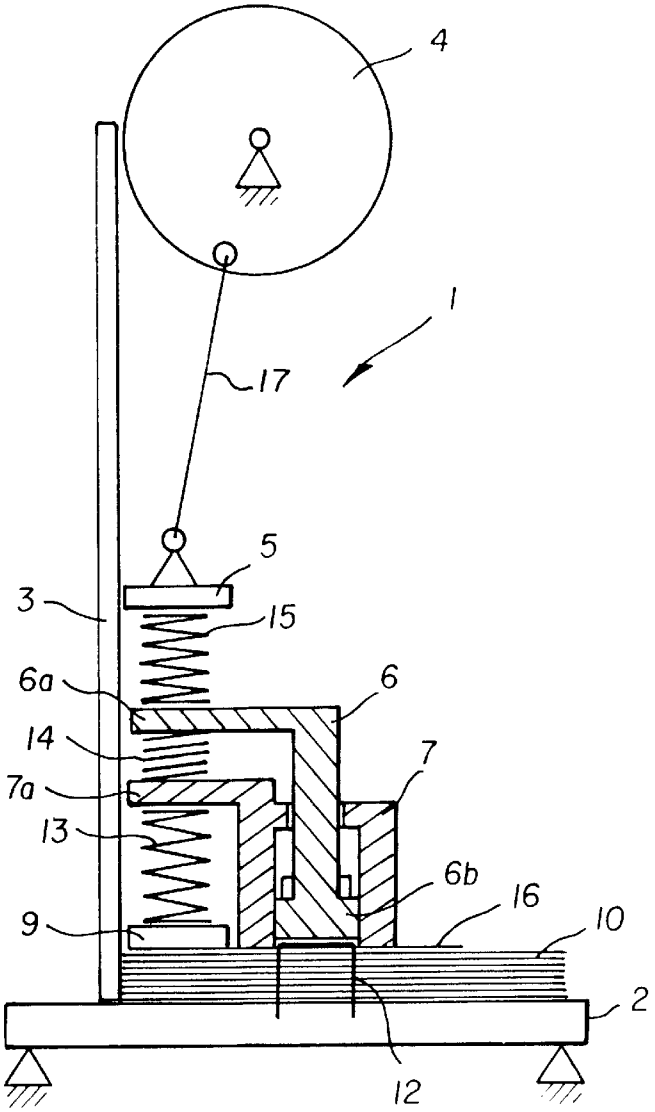
FIG. 5 is the device according to FIG. 4, during compensation for stack thickness.
Figure 4:
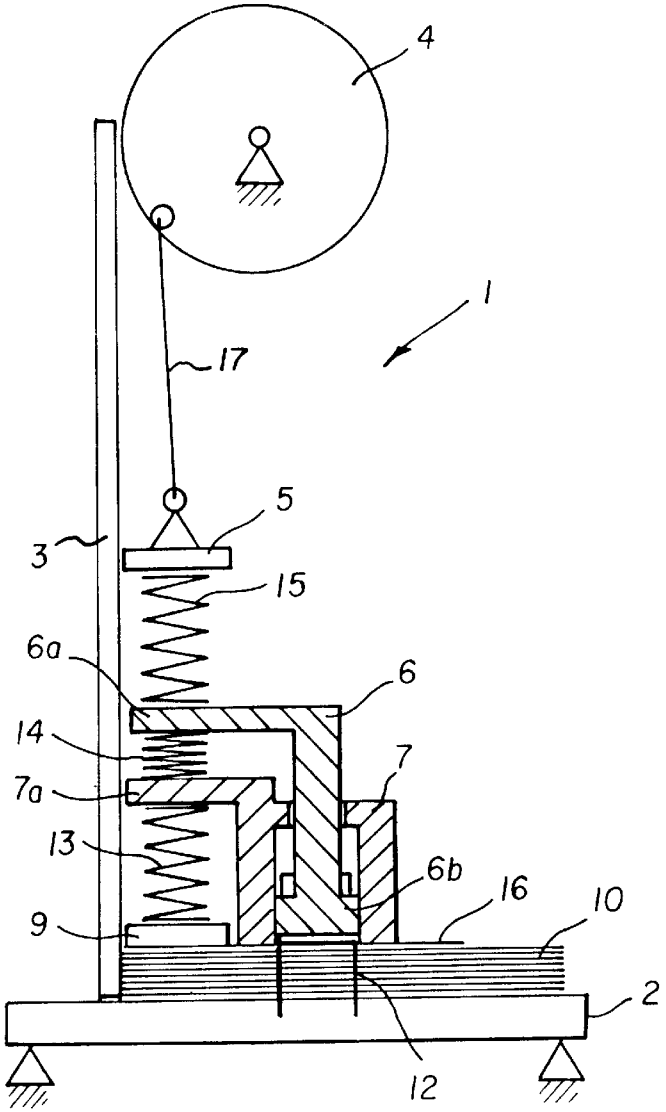
FIG. 4 is the device according to FIG. 1, during penetration of the staple.

The actual stapling operation is then performed by driving staple 12 into sheet stack 10, as shown in FIGS. 4 and 5. This is accomplished by staple driving means 6 which is driven by the eccentric drive 4, 17 and by the strongest third pressure spring 15 to overcome the force of the weaker second pressure spring 14 and to move staple driving means 6 in the direction of the arrow "B", thereby compressing second pressure spring 14. While being driven in, the legs of staple 12 are positively guided in a known fashion (not depicted) on lateral guide grooves of staple forming member 7.

Once staple 12 has penetrated into sheet stack 10, the staple ends protruding from the underside of sheet stack 10 are laid in known fashion by means of a clinching device (not depicted) against the back side of sheet stack 10. Eccentric drive 4, 17 is driven in the direction of the arrow "B" during the entire stapling and clinching operation, with different sheet stack thicknesses being compensated for by the compression of third pressure spring 15.

After completion of the stapling operation, stapling device 1 is moved back in a direction opposite to the direction of the arrow "B," by means of eccentric drive 4, 17 rotating in the direction of the arrow "C," into its raised initial position shown in FIG. 1; during this return movement, pressure springs 13, 14, 15 can spring back into their preloaded initial positions as shown in FIG. 1. During the return movement of stapling device 1, bending block 8 is pivoted back into its working position beneath staple forming member 7.

The invention has been described with reference to a preferred embodiment; However, it will be appreciated that variations and modifications can be effected by a person of ordinary skill in the art without departing from the scope of the invention.

PARTS LIST:

1 stapling device
2 collecting station
3 support
4 eccentric drive
5 drive head
6 staple driving means
6*a* projection
6*b* extension
7 staple forming member
7*a* projection
8 bending block
9 holddown element
10 sheet stack
11 staple wire
12 staples
13 first pressure spring
14 second pressure spring
15 third pressure spring
16 lower limiting means
17 eccentric drive

What is claimed is:

1. Stapling device for stapling a stack of sheets by means of staples, in which the staples are formed from wire in the stapling device and are subsequently driven into the sheet stack, characterized in that the stapling device has a holddown element, a staple forming member, and a staple driving means, which are guided linearly and are movable perpendicular to the upper side of the stack;

a first, a second, and a third pressure spring, with identical working directions but with different spring forces in each case, are arranged perpendicular to the upper side of the stack;

the first pressure spring engages on the holddown element associated with the upper side of the stack and has a low spring force;

the second pressure spring is associated with the staple forming member and has a spring force which is greater than that of the first pressure spring;

the third pressure spring is associated with the staple driving means and has a spring force which is greater than that of the second pressure spring;

the pressure springs can be acted upon by a common drive mechanism of the stapling device which is movable in the working direction of the pressure springs;

the drive mechanism is associated with the one end of the pressure spring arrangement; and the other end of the pressure spring arrangement faces toward the sheet stack (10) to be stapled.

2. Stapling device as defined in claim 1, characterized in that the first pressure spring is arranged in preloaded fashion between the holddown element and the staple forming member;

the second pressure spring is arranged in preloaded fashion between the staple forming member and the staple driving means; and the third pressure spring is arranged in preloaded fashion between the staple driving means and a counterbearing that is movable by the drive mechanism.

* * * * *